US010035354B1

(12) United States Patent
Piatt et al.

(10) Patent No.: US 10,035,354 B1
(45) Date of Patent: Jul. 31, 2018

(54) JETTING MODULE FLUID COUPLING SYSTEM

(71) Applicant: Eastman Kodak Company, Rochester, NY (US)

(72) Inventors: Michael J. Piatt, Dayton, OH (US); Scott F. Roberts, New Carlisle, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 15/612,088

(22) Filed: Jun. 2, 2017

(51) Int. Cl.
*B41J 2/175* (2006.01)

(52) U.S. Cl.
CPC ..... *B41J 2/17523* (2013.01); *B41J 2/17526* (2013.01)

(58) Field of Classification Search
CPC ..... B41J 2/17523; B41J 2/17526
See application file for complete search history.

(56) References Cited

U.S. PATENT DOCUMENTS 6,457,807 B1 10/2002 Hawkins et al.
6,491,362 B1 12/2002 Jeanmaire
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.
6,793,328 B2 9/2004 Jeanmaire
6,827,429 B2 12/2004 Jeanmaire et al.
6,851,796 B2 2/2005 Jeanmaire et al.
7,192,108 B2 3/2007 Lyman
7,819,501 B2 10/2010 Hanchak et al.
8,226,215 B2 7/2012 Bechler et al.
8,585,189 B1 11/2013 Marcus et al.
8,651,632 B2 2/2014 Marcus
8,651,633 B2 2/2014 Marcus et al.
8,696,094 B2 4/2014 Marcus et al.
8,888,256 B2 11/2014 Marcus et al.
2009/0179968 A1* 7/2009 Hibbard ..... B41J 2/175 347/85
2015/0224781 A1* 8/2015 Powell ..... B41J 2/1752 347/86

* cited by examiner

*Primary Examiner* — Huan Tran
(74) *Attorney, Agent, or Firm* — Kevin E. Spaulding

(57) ABSTRACT

An inkjet printing system includes a fluid coupling assembly for supplying fluid to a jetting module. The jetting module includes an electrical connector adapted to connect with a corresponding electrical cable, and a jetting module attachment face with a jetting module fluid port. The fluid coupling assembly includes a coupling assembly attachment face with a coupling assembly fluid port in a position corresponding to the jetting module fluid port. A latch mechanism on the fluid coupling assembly includes a latch handle and a latch fastener adapted to engage with a latch keeper on the jetting module. When the latch handle is in a first disengaged position the latch mechanism blocks the electrical connector, and when the latch handle is in a second engaged position the latch fastener engages the latch keeper to secure the fluid coupling assembly to the jetting module.

20 Claims, 19 Drawing Sheets

JETTING MODULE FLUID COUPLING SYSTEM

FIELD OF THE INVENTION

This invention pertains to the field of inkjet printing, and more particularly to a fluid coupling system for a jetting module in an inkjet printing system.

BACKGROUND OF THE INVENTION

In inkjet printers, there is a need to make fluid and electrical connections to a field-replaceable jetting module. Commonly-assigned U.S. Pat. No. 7,819,501 (Hanchak et al.), entitled "Jetting module installation and alignment apparatus," described a jetting module installation mechanism that lowers a jetting module into place within an inkjet printhead and then applies a clamping force on the jetting module to ensure it stays in alignment with other components of the inkjet printhead. The same mechanism also provides electrical and fluid connections with the jetting module. Commonly-assigned U.S. Pat. No. 8,226,215 (Bechler et al.), entitled "Jetting module install mechanism," described a different jetting module installation mechanism for use in an inkjet linehead that includes a plurality of printheads, each of which involve field replaceable jetting modules to which fluid and electrical connections must be made.

While these systems generally work well, there remains a need for simplified systems for making fluid and electric connections to the field replaceable jetting modules which can provide enhanced reliability and lower cost.

SUMMARY OF THE INVENTION

The present invention represents an inkjet printing system, including:

- a jetting module including:
  - an electrical connector adapted to connect with a corresponding electrical cable;
  - a jetting module attachment face including a jetting module fluid port; and
  - a latch keeper; and
- a fluid coupling assembly that provides a fluid coupling to the jetting module including:
  - a coupling assembly attachment face including a coupling assembly fluid port in a position corresponding to the jetting module fluid port; and
  - a latch mechanism including:
    - a latch fastener adapted to engage with the latch keeper; and
    - a repositionable latch handle for operating the latch mechanism;

wherein when the latch handle is in a first position the latch fastener is disengaged from the latch keeper, and when the latch handle is in a second position the latch fastener engages the latch keeper to secure the attachment face of the fluid coupling assembly to the attachment face of the jetting module such that there is a leak-proof fluid connection between the jetting module fluid port and the coupling assembly fluid port; and wherein when the latch handle is in the first position a portion of the latch mechanism blocks the electrical connector such that the electrical cable is prevented from connecting with the electrical connector, and when the latch handle is in the second position the electrical connection is not blocked such that the electrical cable can be connected with the electrical connector.

This invention has the advantage that the electrical cable cannot be connected to the jetting module before the fluid coupling assembly is secured to the jetting module. This prevents fluid from being supplied to the fluid coupling assembly when it is not secured onto the jetting module.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use printheads to emit liquids (other than inks) that need to be finely metered and deposited with high spatial precision. These applications include application of medicinal compounds, application of materials for forming electronic components, application of catalytic materials for initiating electroless plating operations, and application of masking materials for shielding selective portions of a substrate for subsequent deposition or material removal processes, application of binder materials to layer of granular material for the forming of three dimensional structures. As such, as described herein, the terms "liquid" and "ink" refer to any material that can be ejected by the printhead or printhead components described below.

Figure 1:
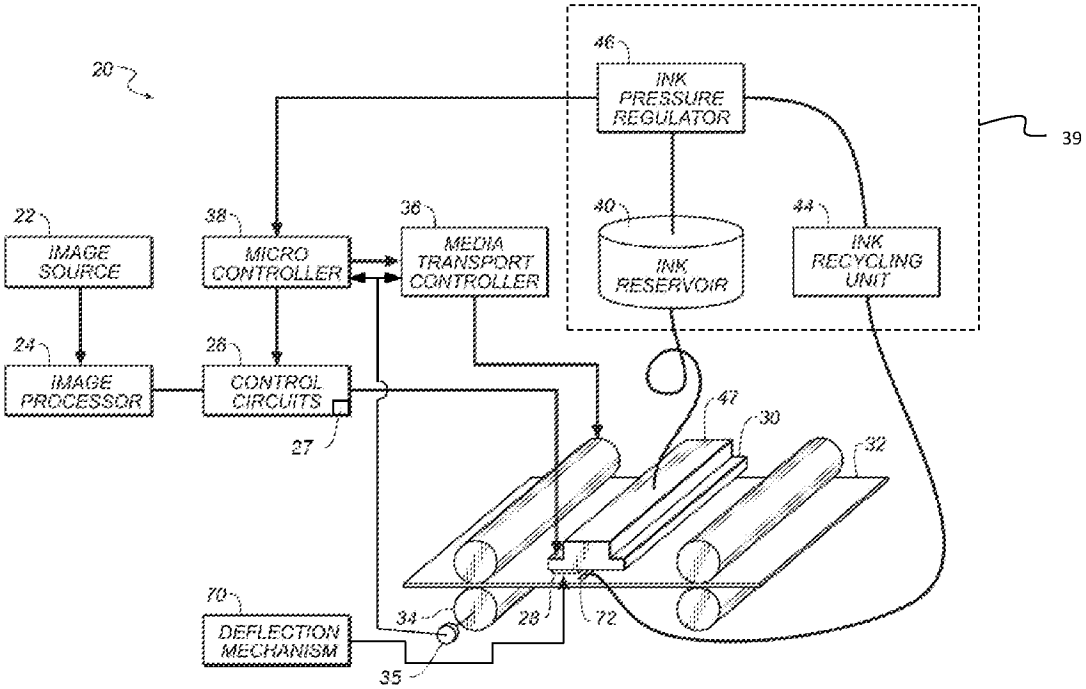
FIG. 1 (Prior Art)
FIG. 1 is a simplified block schematic diagram of an exemplary continuous inkjet system in accordance with the present invention.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit (image processor) 24 which also stores the image data in memory. A plurality of drop forming transducer control circuits 26 reads data from the image memory and apply time-varying electrical pulses to a drop forming transducers 28 that are associated with one or more nozzles of a printhead 30. These pulses are applied at an appropriate time, and to the appropriate nozzles, so that drops formed from a continuous ink jet stream will form spots on a print medium 32 in the appropriate position designated by the data in the image memory.

Print medium 32 is moved relative to the printhead 30 by a print medium transport system 34, which is electronically controlled by a media transport controller 36 in response to signals from a speed measurement device 35. The media transport controller 36 is in turn is controlled by a micro-controller 38. The print medium transport system shown in FIG. 1 is a schematic only, and many different mechanical configurations are possible. For example, a transfer roller could be used in the print medium transport system 34 to facilitate transfer of the ink drops to the print medium 32. Such transfer roller technology is well known in the art. In the case of page width printheads, it is most convenient to move the print medium 32 along a media path past a stationary printhead. However, in the case of scanning print systems, it is often most convenient to move the printhead along one axis (the sub-scanning direction) and the print medium 32 along an orthogonal axis (the main scanning direction) in a relative raster motion.

Ink is contained in an ink reservoir 40 under pressure. In the non-printing state, continuous ink jet drop streams are unable to reach print medium 32 due to an ink catcher 72 that blocks the stream of drops, and which may allow a portion of the ink to be recycled by an ink recycling unit 44. The ink recycling unit 44 reconditions the ink and feeds it back to the ink reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to the ink reservoir 40 under the control of an ink pressure regulator 46. Alternatively, the ink reservoir can be left unpressurized, or even under a reduced pressure (vacuum), and a pump can be employed to deliver ink from the ink reservoir under pressure to the printhead 30. In such an embodiment, the ink pressure regulator 46 can include an ink pump control system. Collectively, the ink reservoir 40, the ink pressure regulator 46, and the ink recycling unit 44 is often referred to as the fluid system 39 of the inkjet printing system 20. The ink is distributed to the printhead 30 through an ink channel 47. The ink preferably flows through slots or holes etched through a silicon substrate of printhead 30 to its front surface, where a plurality of nozzles and drop forming transducers, for example, heaters, are situated. When printhead 30 is fabricated from silicon, the drop forming transducer control circuits 26 can be integrated with the printhead 30. The printhead 30 also includes a deflection mechanism 70 which is described in more detail below with reference to FIGS. 2 and 3.

Figure 2:
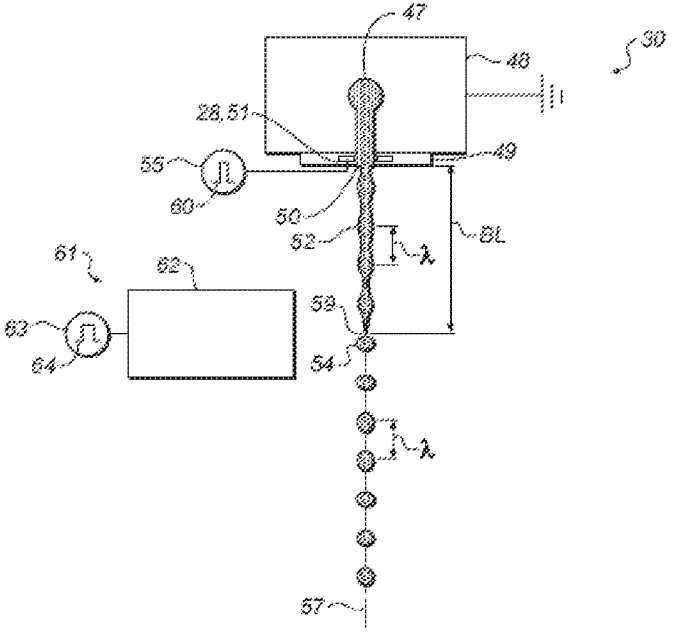
FIG. 2 shows an image of a liquid jet being ejected from a drop generator and its subsequent break off into drops with a regular period.

Referring to FIG. 2, a schematic view of continuous liquid printhead 30 is shown. A jetting module 48 of printhead 30 includes an array of nozzles 50 formed in a nozzle plate 49. In FIG. 2, nozzle plate 49 is affixed to the jetting module 48. Alternatively, the nozzle plate 49 can be integrally formed with the jetting module 48. Liquid, for example, ink, is supplied to the nozzles 50 via ink channel 47 at a pressure sufficient to form continuous liquid streams 52 (sometimes referred to as filaments) from each nozzle 50. In FIG. 2, the array of nozzles 50 extends into and out of the figure.

Jetting module 48 is operable to cause liquid drops 54 to break off from the liquid stream 52 in response to image data. To accomplish this, jetting module 48 includes a drop stimulation or drop forming transducer 28 (e.g., a heater, a piezoelectric actuator, or an electrohydrodynamic stimulation electrode), that, when selectively activated, perturbs the liquid stream 52, to induce portions of each filament to break off and coalesce to form the drops 54. Depending on the type of transducer used, the transducer can be located in or adjacent to the liquid chamber that supplies the liquid to the nozzles 50 to act on the liquid in the liquid chamber, can be located in or immediately around the nozzles 50 to act on the liquid as it passes through the nozzle, or can be located adjacent to the liquid stream 52 to act on the liquid stream 50 after it has passed through the nozzle 50.

In FIG. 2, drop forming transducer 28 is a heater 51, for example, an asymmetric heater or a ring heater (either segmented or not segmented), located in the nozzle plate 49 on one or both sides of the nozzle 50. This type of drop formation is known and has been described in, for example, commonly-assigned U.S. Pat. No. 6,457,807 (Hawkins et al.); U.S. Pat. No. 6,491,362 (Jeanmaire); U.S. Pat. No. 6,505,921 (Chwalek et al.); U.S. Pat. No. 6,554,410 (Jeanmaire et al.); U.S. Pat. No. 6,575,566 (Jeanmaire et al.); U.S. Pat. No. 6,588,888 (Jeanmaire et al.); U.S. Pat. No. 6,793,328 (Jeanmaire); U.S. Pat. No. 6,827,429 (Jeanmaire et al.); and U.S. Pat. No. 6,851,796 (Jeanmaire et al.), each of which is incorporated herein by reference.

Typically, one drop forming transducer 28 is associated with each nozzle 50 of the nozzle array. However, in some configurations, a drop forming transducer 28 can be associated with groups of nozzles 50 or all of the nozzles 50 in the nozzle array.

Referring to FIG. 2 the printing system has associated with it, a printhead 30 that is operable to produce, from an array of nozzles 50, an array of liquid streams 52. A drop forming device is associated with each liquid stream 52. The drop formation device includes a drop forming transducer 28 and a drop formation waveform source 55 that supplies a drop formation waveform 60 to the drop forming transducer 28. The drop formation waveform source 55 is a portion of the mechanism control circuits 26. In some embodiments in which the nozzle plate is fabricated of silicon, the drop formation waveform source 55 is formed at least partially on the nozzle plate 49. The drop formation waveform source 55 supplies a drop formation waveform 60 that typically includes a sequence of pulses having a fundamental frequency $f_O$ and a fundamental period of $T_O=1/f_O$ to the drop formation transducer 28, which produces a modulation with a wavelength $\lambda$, in the liquid jet. The modulation grows in amplitude to cause portions of the liquid stream 52 to break off into drops 54. Through the action of the drop formation device, a sequence of drops 54 is produced. In accordance with the drop formation waveform 60, the drops 54 are formed at the fundamental frequency $f_O$ with a fundamental period of $T_O=1/f_O$. In FIG. 2, liquid stream 52 breaks off into drops with a regular period at break off location 59, which is a distance, called the break off length, BL from the nozzle 50. The distance between a pair of successive drops 54 is essentially equal to the wavelength $\lambda$ of the perturbation on the liquid stream 52. The stream of drops 54 formed from the liquid stream 52 follow an initial trajectory 57.

The break off time of the droplet for a particular printhead can be altered by changing at least one of the amplitude, duty cycle, or number of the stimulation pulses to the respective resistive elements surrounding a respective resistive nozzle orifice. In this way, small variations of either pulse duty cycle or amplitude allow the droplet break off times to be modulated in a predictable fashion within ±one-tenth the droplet generation period.

Also, shown in FIG. 2 is a charging device 61 comprising charging electrode 62 and charging electrode waveform source 63. The charging electrode 62 associated with the liquid jet is positioned adjacent to the break off point 59 of the liquid stream 52. If a voltage is applied to the charging electrode 62, electric fields are produced between the charging electrode and the electrically grounded liquid jet, and the capacitive coupling between the two produces a net charge on the end of the electrically conductive liquid stream 52. (The liquid stream 52 is grounded by means of contact with the liquid chamber of the grounded drop generator.) If the end portion of the liquid jet breaks off to form a drop while there is a net charge on the end of the liquid stream 52, the charge of that end portion of the liquid stream 52 is trapped on the newly formed drop 54.

Figure 4:
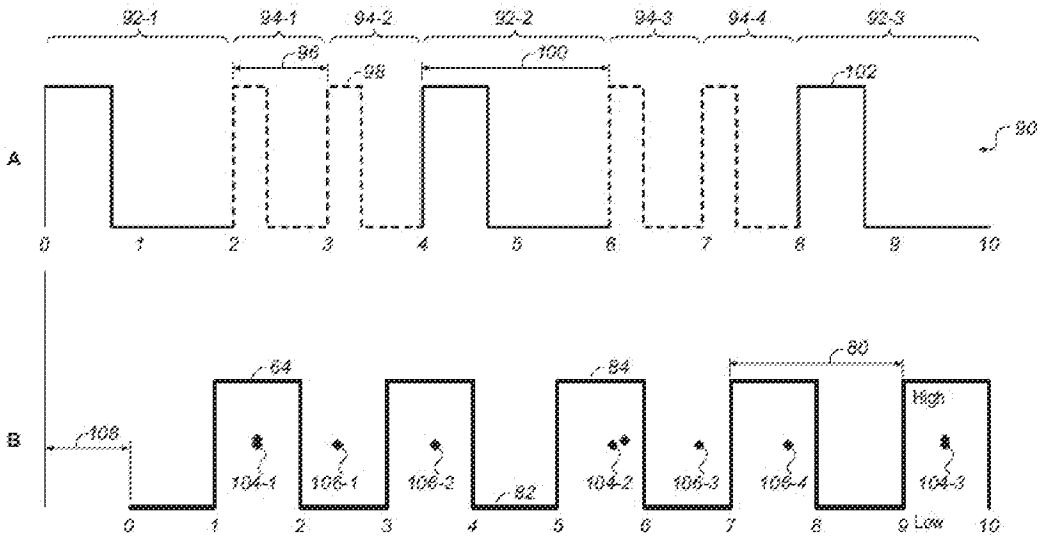
FIG. 4 (Prior Art)
FIG. 4 shows a first example embodiment of a timing diagram illustrating drop formation pulses, the charging electrode waveform, and the break-off of drops.

The voltage on the charging electrode 62 is controlled by the charging electrode waveform source 63, which provides a charging electrode waveform 64 operating at a charging electrode waveform 64 period 80 (shown in FIG. 4). The charging electrode waveform source 63 provides a varying electrical potential between the charging electrode 62 and the liquid stream 52. The charging electrode waveform source 63 generates a charging electrode waveform 64, which includes a first voltage state and a second voltage state; the first voltage state being distinct from the second voltage state. An example of a charging electrode waveform is shown in part B of FIG. 4. The two voltages are selected such that the drops 54 breaking off during the first voltage state acquire a first charge state and the drops 54 breaking off during the second voltage state acquire a second charge state. The charging electrode waveform 64 supplied to the charging electrode 62 is independent of, or not responsive to, the image data to be printed. The charging device 61 is synchronized with the drop formation device using a conventional synchronization device 27, which is a portion of the control circuits 26, (see FIG. 1) so that a fixed phase relationship is maintained between the charging electrode waveform 64 produced by the charging electrode waveform source 63 and the clock of the drop formation waveform source 55. As a result, the phase of the break off of drops 54 from the liquid stream 52, produced by the drop formation waveforms 92-1, 92-2, 92-3, 94-1, 94-2, 94-3, 94-4 (see FIG. 4), is phase locked to the charging electrode waveform 64. As indicated in FIG. 4, there can be a phase shift 108, between the charging electrode waveform 64 and the drop formation waveforms 92-1, 92-2, 92-3, 94-1, 94-2, 94-3, 94-4.

Figure 3:
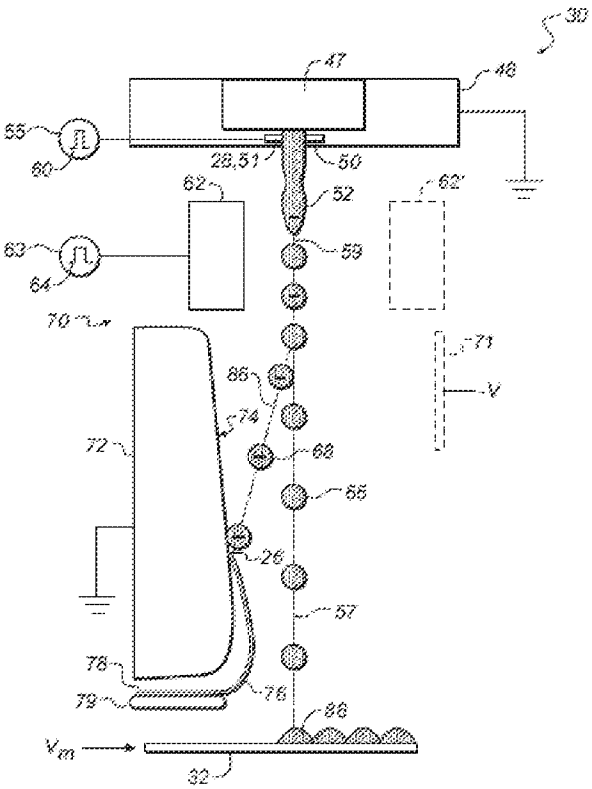
FIG. 3 shows a cross sectional of an inkjet printhead of the continuous liquid ejection system in accordance with the present invention.

With reference now to FIG. 3, printhead 30 includes a drop forming transducer 28 which creates a liquid stream 52 that breaks up into ink drops 54. Selection of drops 54 as printing drops 66 or non-printing drops 68 will depend upon the phase of the droplet break off relative to the charging electrode voltage pulses that are applied to the to the charging electrode 62 that is part of the deflection mechanism 70, as will be described below. The charging electrode 62 is variably biased by a charging electrode waveform source 63. The charging electrode waveform source 63 provides charging electrode waveform 64, also called a charging electrode waveform 64, in the form of a sequence of charging pulses. The charging electrode waveform 64 is periodic, having a charging electrode waveform 64 period 80 (FIG. 4).

An embodiment of a charging electrode waveform 64 is shown in part B of FIG. 4. The charging electrode waveform 64 comprises a first voltage state 82 and a second voltage state 84. Drops breaking off during the first voltage state 82 are charged to a first charge state and drops breaking off during the second voltage state 84 are charged to a second charge state. The second voltage state 84 is typically at a high level, biased sufficiently to charge the drops 54 as they break off. The first voltage state 82 is typically at a low level relative to the printhead 30 such that the first charge state is relatively uncharged when compared to the second charge state. An exemplary range of values of the electrical potential difference between the first voltage state 82 and a second voltage state 84 is 50 to 300 volts and more preferably 90 to 150 volts.

Returning to a discussion of FIG. 3, when a relatively high level voltage or electrical potential is applied to the charging electrode 62 and a drop 54 breaks off from the liquid stream 52 in front of the charging electrode 62, the drop 54 acquires a charge and is deflected by deflection mechanism 70 towards the ink catcher 72 as non-print drops 68. The non-printing drops 68 that strike the catcher face 74 form an ink film 76 on the face of the ink catcher 72. The ink film 76 flows down the catcher face 74 and enters liquid channel 78 (also called an ink channel), through which it flows to the ink recycling unit 44. The liquid channel 78 is typically formed between the body of the catcher 72 and a lower plate 79.

Deflection occurs when drops 54 break off from the liquid stream 52 while the potential of the charging electrode 62 is provided with an appropriate voltage. The drops 54 will then acquire an induced electrical charge that remains upon the droplet surface. The charge on an individual drop 54 has a polarity opposite that of the charging electrode 62 and a magnitude that is dependent upon the magnitude of the voltage and the coupling capacitance between the charging electrode 52 and the drop 54 at the instant the drop 54 separates from the liquid jet. This coupling capacitance is dependent in part on the spacing between the charging electrode 62 and the drop 54 as it is breaking off. It can also be dependent on the vertical position of the break off point 59 relative to the center of the charge electrode 62. After the charge drops 54 have broken away from the liquid stream 52, they continue to pass through the electric fields produced by the charge plate. These electric fields provide a force on the charged drops deflecting them toward the charging electrode 62. The charging electrode 62, even though it cycled between the first and the second voltage states, thus acts as a deflection electrode to help deflect charged drops away from the initial trajectory 57 and toward the catcher 72. After passing the charging electrode 62, the drops 54 will travel in close proximity to the catcher face 74, which is typically constructed of a conductor or dielectric. The charges on the surface of the non-printing drops 68 will induce either a surface charge density charge (for a catcher face 74 constructed of a conductor) or a polarization density charge (for a catcher face 74 constructed of a dielectric). The induced charges on the catcher face 74 produce an attractive force on the charged non-printing drops 68. The attractive force on the non-printing drops 68 is identical to that which would be produced by a fictitious charge (opposite in polarity and equal in magnitude) located inside the ink catcher 72 at a distance from the surface equal to the distance between the ink catcher 72 and the non-printing drops 68. The fictitious charge is called an image charge. The attractive force exerted on the charged non-printing drops 68 by the catcher face 74 causes the charged non-printing drops 68 to deflect away from their initial trajectory 57 and accelerate along a non-print trajectory 86 toward the catcher face 74 at a rate proportional to the square of the droplet charge and inversely proportional to the droplet mass. In this embodiment, the ink catcher 72, due to the induced charge distribution, comprises a portion of the deflection mechanism 70. In other embodiments, the deflection mechanism 70 can include one or more additional electrodes to generate an electric field through which the charged droplets pass so as to deflect the charged droplets. For example, an optional single biased deflection electrode 71 in front of the upper grounded portion of the catcher can be used. In some embodiments, the charging electrode 62 can include a second portion on the second side of the jet array, denoted by the dashed line electrode 62', which supplied with the same charging electrode waveform 64 as the first portion of the charging electrode 62.

In the alternative, when the drop formation waveform 60 applied to the drop forming transducer 28 causes a drop 54 to break off from the liquid stream 52 when the electrical potential of the charging electrode 62 is at the first voltage state 82 (FIG. 4) (i.e., at a relatively low potential or at a zero potential), the drop 54 does not acquire a charge. Such uncharged drops are unaffected during their flight by electric fields that deflect the charged drops. The uncharged drops therefore become printing drops 66, which travel in a generally undeflected path along the trajectory 57 and impact the print medium 32 to form a print dots 88 on the print medium 32, as the recoding medium is moved past the printhead 30 at a speed $V_m$. The charging electrode 62, deflection electrode 71 and ink catcher 72 serve as a drop selection system 69 for the printhead 30.

FIG. 4 illustrates how selected drops can be printed by the control of the drop formation waveforms supplied to the drop forming transducer 28. Section A of FIG. 4 shows a drop formation waveform 60 formed as a sequence that includes three drop formation waveforms 92-1, 92-2, 92-3, and four drop formation waveforms 94-1, 94-2, 94-3, 94-4. The drop formation waveforms 94-1, 94-2, 94-3, 94-4 each have a period 96 and include a pulse 98, and each of the drop formation waveforms 92-1, 92-2, 92-3 have a longer period 100 and include a longer pulse 102. In this example, the period 96 of the drop formation waveforms 94-1, 94-2, 94-3, 94-4 is the fundamental period $T_O$, and the period 100 of the drop formation waveforms 92-1, 92-2, 92-3 is twice the fundamental period, $2T_O$. The drop formation waveforms 94-1, 94-2, 94-3, 94-4 each cause individual drops to break off from the liquid stream. The drop formation waveforms 92-1, 92-2, 92-3, due to their longer period, each cause a larger drop to be formed from the liquid stream. The larger drops 54 formed by the drop formation waveforms 92-1, 92-2, 92-3 each have a volume that is approximately equal to twice the volume of the drops 54 formed by the drop formation waveforms 94-1, 94-2, 94-3, 94-4.

As previously mentioned, the charge induced on a drop 54 depends on the voltage state of the charging electrode at the instant of drop break off. The B section of FIG. 4 shows the charging electrode waveform 64 and the times, denoted by the diamonds, at which the drops 54 break off from the liquid stream 52. The waveforms 92-1, 92-2, 92-3 cause large drops 104-1, 104-2, 104-3 to break off from the liquid stream 52 while the charging electrode waveform 64 is in the second voltage state 84. Due to the high voltage applied to the charging electrode 62 in the second voltage state 84, the large drops 104-1, 104-2, 104-3 are charged to a level that causes them to be deflected as non-printing drops 68 such that they strike the catcher face 74 of the ink catcher 72 in FIG. 3. These large drops may be formed as a single drop (denoted by the double diamond for 104-1), as two drops that break off from the liquid stream 52 at almost the same time that subsequently merge to form a large drop (denoted by two closely spaced diamonds for 104-2), or as a large drop that breaks off from the liquid stream that breaks apart and then merges back to a large drop (denoted by the double diamond for 104-3). The waveforms 94-1, 94-2, 94-3, 94-4 cause small drops 106-1, 106-2, 106-3, 106-4 to form. Small drops 106-1 and 106-3 break off during the first voltage state 82, and therefore will be relatively uncharged; they are not deflected into the ink catcher 72, but rather pass by the ink catcher 72 as printing drops 66 and strike the print media 32 (see FIG. 3). Small drops 106-2 and 106-4 break off during the second voltage state 84 and are deflected to strike the ink catcher 74 as non-printing drops 68. The charging electrode waveform 64 is not controlled by the pixel data to be printed, while the drop formation waveform 60 is determined by the print data. This type of drop deflection is known and has been described in, for example, commonly-assigned U.S. Pat. No. 8,585,189 (Marcus et al.); U.S. Pat. No. 8,651,632 (Marcus); U.S. Pat. No. 8,651,633 (Marcus et al.); U.S. Pat. No. 8,696,094 (Marcus et al.); and U.S. Pat. No. 8,888,256 (Marcus et al.), each of which is incorporated herein by reference.

One or more fluid connections must be made with a jetting module 48 when it is installed within an inkjet printing system 20. These fluid connections can include a fluid supply line to the jetting module 48 and a fluid return line from the jetting to the fluid system 39. One or more electrical connections must also be made with the jetting module 48. These electrical connections can be used to provide drop formation waveforms 92-1, 92-2, 92-3, 94-1, 94-2, 94-3, 94-4 to the drop forming transducers 28 of the jetting module 48. Additionally, the electrical connections can include communications with a jetting module memory in which can be stored various operating parameters associated with the particular jetting module 48, such as drop formation waveform scaling factors and phase shift values between the drop formation waveforms and the charging electrode waveform 64. The communications with the jetting module memory through the electrical connections can also include information concerning the inks or other fluids previously used in the jetting module 48. This information can be used by the controller to verify that the fluids to be supplied to the jetting module 48 are compatible with any residual fluids left in the jetting module 48 from previous use of the jetting module 48 before supplying the new fluids to the jetting module 48, as discussed in commonly-assigned U.S. Pat. No. 7,192,108, which is incorporated herein by reference. Some inkjet printing systems 20 can include a large number of jetting modules 48, each of which can be operated independently of other jetting modules 48. For example, in some printing systems 20 it is possible to carry on maintenance functions on one jetting module 48, including removing and replacing the jetting module 48 while the other jetting modules 48 remain in their operating state. In such systems, it is highly desirable for the controller to verify that a jetting module 48 is installed and connected to the appropriate fluid and electrical connections before causing fluids to be supplied to that fluid connection.

In some prior art systems, the fluid and electrical connections for mating with the jetting module 48 were both portions of a common coupling assembly. With the jetting module 48 located within the printhead by kinematic locating features, a motor actuator was activated to push the common coupling assembly into contact with the jetting module 48 and thereby cause the fluid and electrical connectors of the common coupling assembly to engage with the corresponding fluid and electrical connections of the jetting module 48. To ensure that the motor actuator had applied the required force on the common coupling assembly to engage all the fluid and electrical connection, these prior art systems therefore included a plurality of sensors for verifying that a jetting module was properly installed and coupled to the fluid and electrical connectors. While this system worked quite well, the motor actuator and plurality of sensors added significant cost to the system, and sensor and motor failures lowered the reliability of the printing system 20. The present invention provides a means to verify that the fluid connections to the jetting module 48 are made and secured before making electrical connections to the jetting module 48, without requiring the plurality of sensors required in prior art systems.

Figure 5:
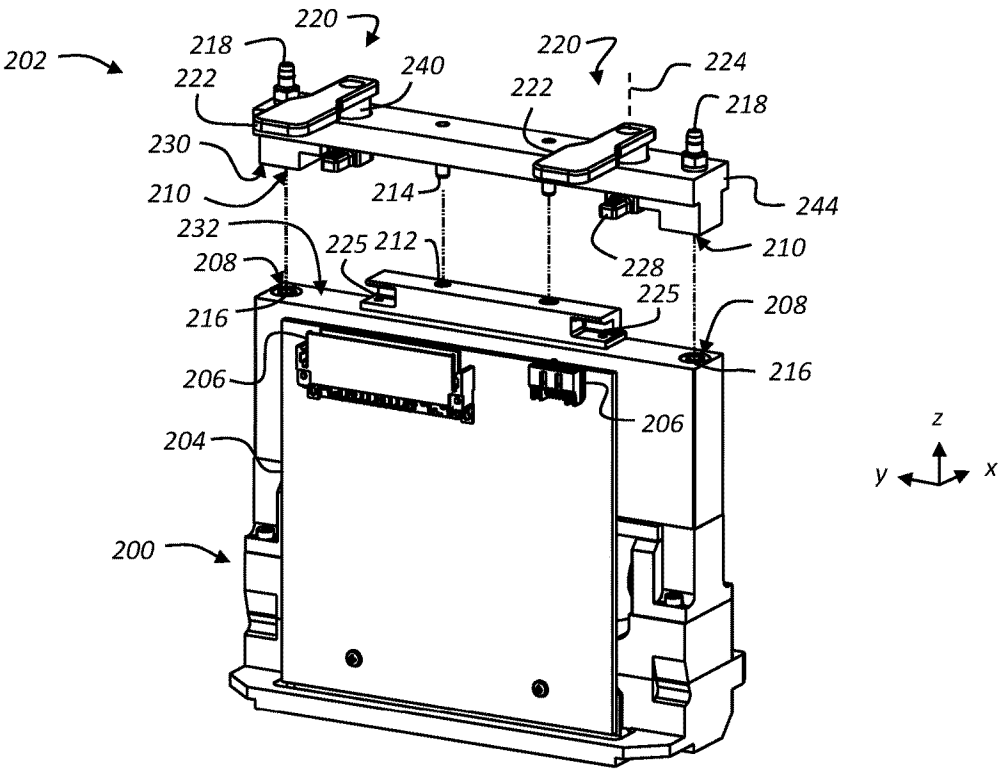
FIG. 5 shows an isometric view of a jetting module and a fluid coupling assembly in accordance with an exemplary embodiment.
Figure 6:
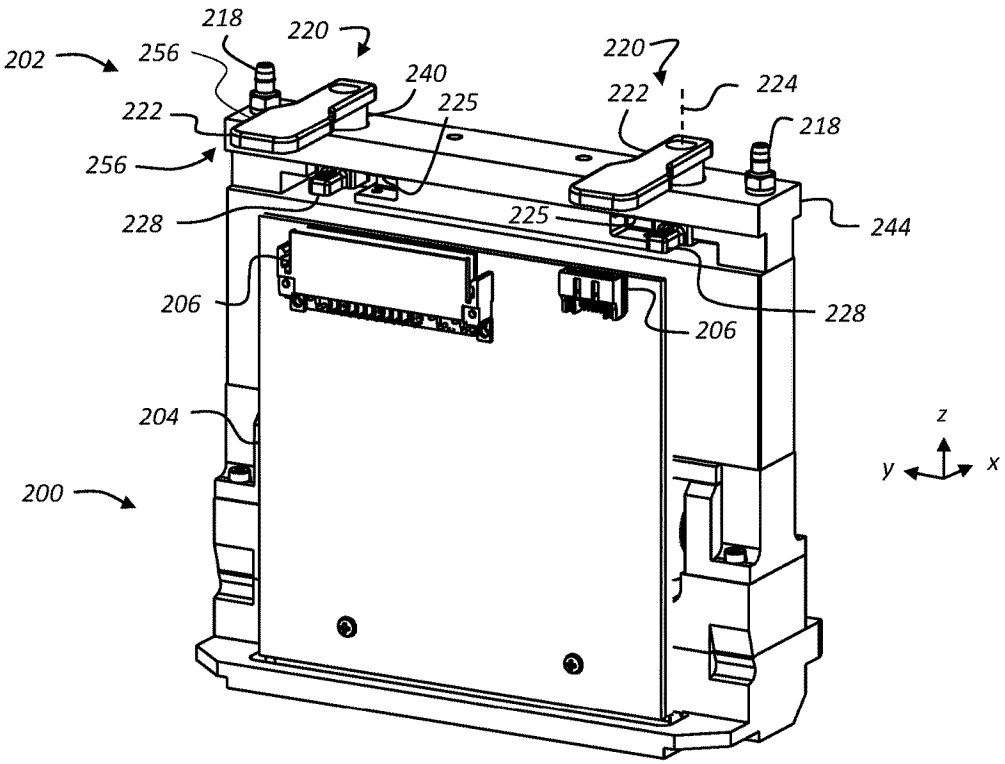
FIG. 6 shows the fluid coupling assembly of FIG. 5 installed onto the jetting module with the latch mechanisms in an unengaged position.
Figure 7:
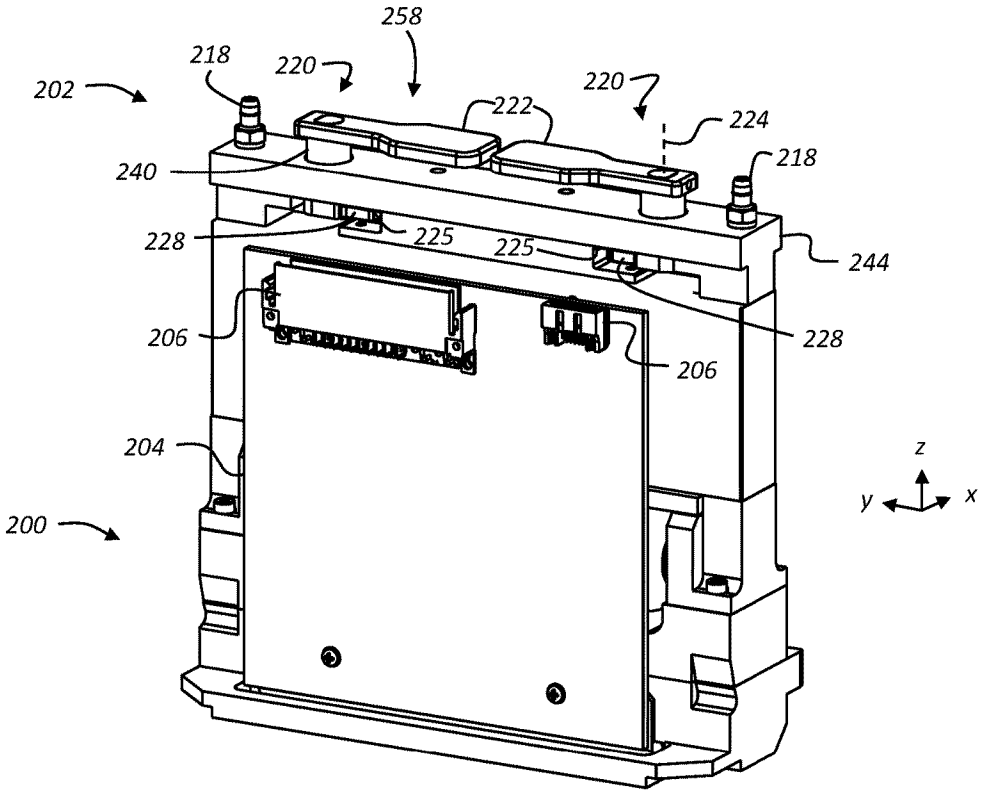
FIG. 7 shows the fluid coupling assembly of FIG. 5 installed onto the jetting module with the latch mechanisms in an engaged position to secure the fluid coupling assembly to the jetting module.

FIGS. 5-7 illustrate an exemplary embodiment of the present invention including a jetting module 200 and along with a fluid coupling assembly 202. In FIG. 5, the fluid coupling assembly 202 is not installed on the jetting module 200, but rather is spaced above the jetting module 200. FIG. 6 shows the fluid coupling assembly 202 placed on the jetting module 200, but not secured or latched in place to the jetting module 200, and FIG. 7 shows the fluid coupling assembly 202 latched in place on the jetting module 200.

The jetting module 200 includes an electronics board 204 with one or more electrical connectors 206 adapted to connect with an electrical cable (not shown in FIGS. 5-7) to make electrical connections with the jetting module 200. An attachment face 232 of the jetting module 200 includes one or more jetting module fluid ports 208. In the embodiment of FIG. 5, there are two jetting module fluid ports 208; one jetting module fluid port 208 being a fluid supply port through which the jetting module 200 receives ink or other fluids from the fluid system 39 (FIG. 1), and the other jetting module fluid port 208 being a fluid return port through which ink or other fluids are returned from the jetting module 200 to the fluid system 39. Some embodiments can include additional jetting module fluid port 208 such as filter air bleed fluid ports (see FIG. 10).

Above the jetting module 200 is a fluid coupling assembly 202 including a body 244. An attachment face 230 of the fluid coupling assembly 202 is adapted to mate with the attachment face 232 of the jetting module. The attachment face 230 includes coupling assembly fluid ports 210 that are positioned to align with the jetting module fluid ports 208. Fittings 218 enable flexible fluid tubes, not shown, to be attached to the fluid coupling assembly 202 in fluid communication with the coupling assembly fluid ports 210.

The jetting module 200 and the fluid coupling assembly 202 can include corresponding alignment features 212, 214, respectively, which engage each other to ensure that the coupling assembly fluid ports 210 align appropriately with the jetting module fluid ports 208. The alignment features 212, 214 can include pins that engage holes and slots, as illustrated in FIG. 5. The engagement of a pin with a hole can define the relative position of the fluid coupling assembly 202 to the jetting module 200 in the x- and y-directions. The engagement of the second pin with the slot defines the rotation around the z-axis. Rotational alignment about the x-axis and the y-axis are provided by contact between the attachment faces 230, 232 of the fluid coupling assembly 202 and the jetting module 200 (tolerances for the rotational alignment may be limited by the thickness and compressibility of the sealing elements 216). The alignment features 212, 214 are not limited to the illustrated pin and hole configurations but rather can take various other forms, such as a surface, an edge, or a corner on one component which contacts and engages with a corresponding feature on the other component.

The jetting module 200 and the fluid coupling assembly 202 can be secured or latched together by means of one or more latch mechanisms 220 of the fluid coupling assembly 202 engaging corresponding latch keepers 225 of the jetting module. The latch mechanism 220 includes a latch fastener 228, which engages the latch keeper 225, and a repositionable latch handle 222 that is used to operate the latch mechanism 220. The repositionable latch handle 222 can be rigidly attached to the latch fastener 228 as is shown in the embodiment of FIG. 5, or as is well known in the art of latches, the latch mechanism 220 can include various linkages to couple the latch handle 222 with the latch fastener 228. When the latch handles 222 are oriented in a first position (as shown in FIG. 6) the latch fasteners 228 are oriented in a disengaged position. When the fluid coupling assembly 202 is installed on the jetting module 200, and the latch handles 222 are oriented in a second position (as shown in FIG. 7) the associated latch fasteners 228 engage with the corresponding latch keepers 225 to secure the fluid coupling assembly 202 to the jetting module 200.

The latch mechanism 220 and latch keeper 225 can take various forms. In the exemplary embodiment of FIGS. 5-7, the latch fastener 228 is a type of a rotating arm or rotating cam latch fastener. With this type of latch mechanism 220, the latch fastener 228 is configured to pivot around a pivot axis 224 normal to the attachment face 230 of the object to be latched (in this example, the fluid coupling assembly 202). The attachment faces 230, 232 of the objects being latched together are the faces of the objects that abut each other when the objects are latched together, and the motion of the attachment faces 230, 232 tends to be approximately perpendicular to the attachment faces 230, 232 as the objects to be latched are brought together.

Figure 14:
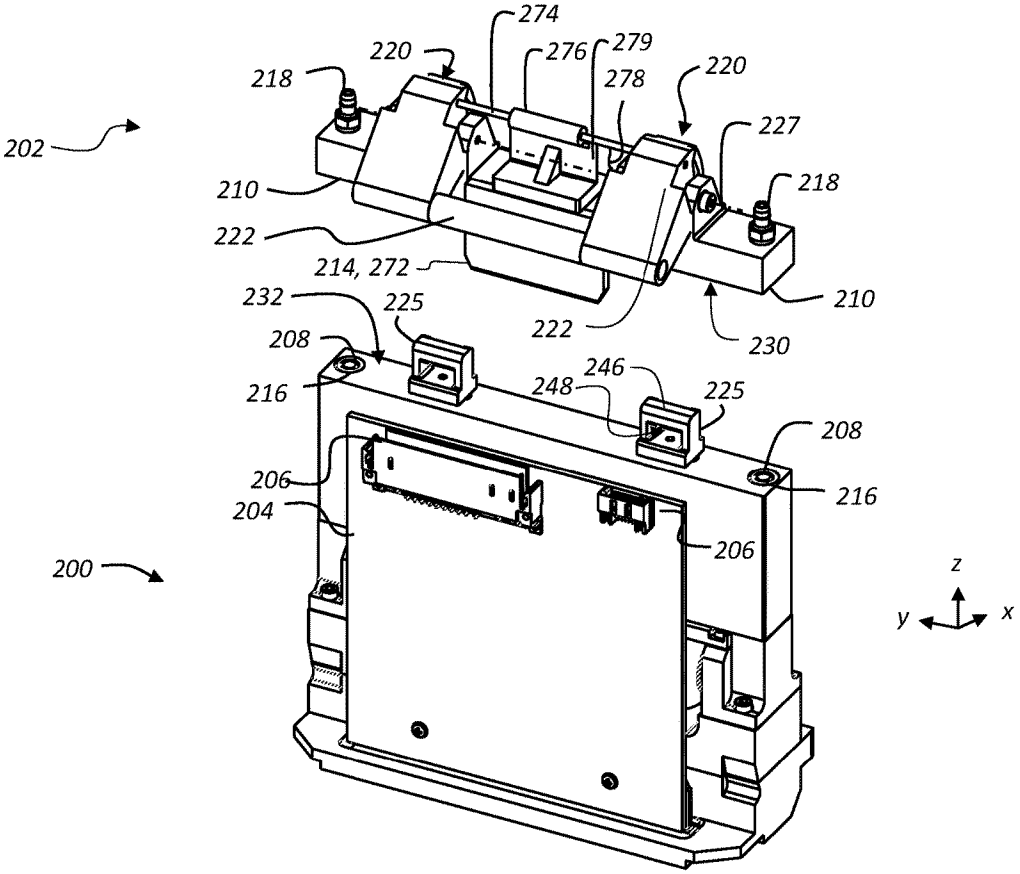
FIG. 14 shows an isometric view of a jetting module and a fluid coupling assembly in accordance with another exemplary embodiment.
Figure 15:
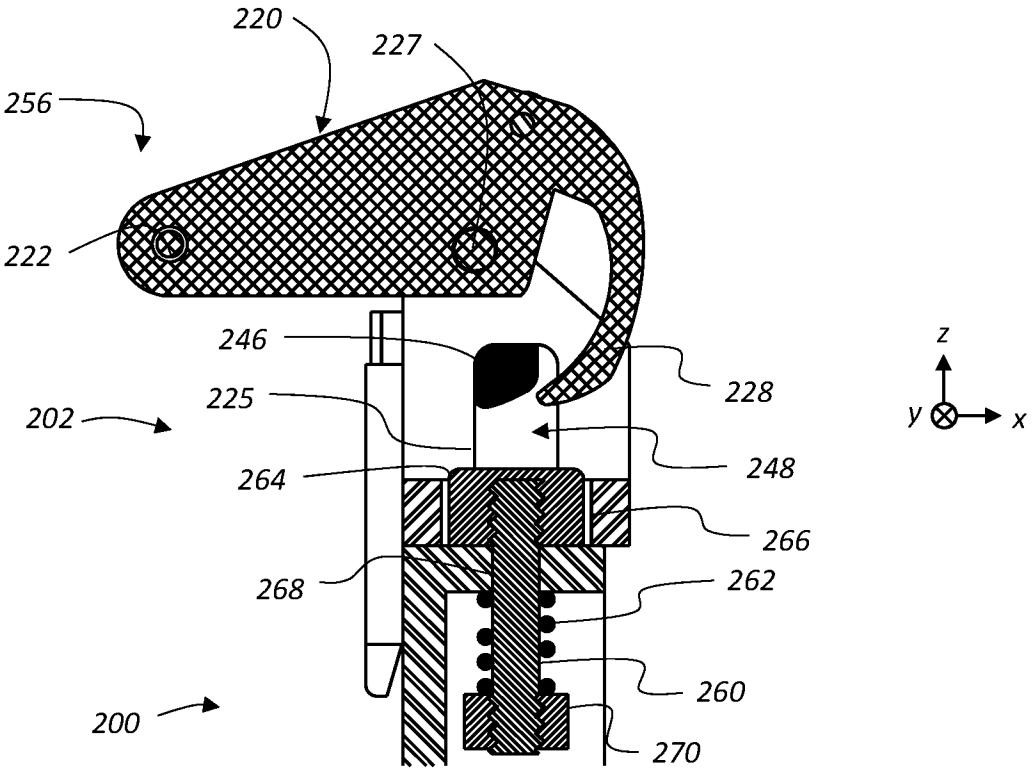
FIG. 15 shows a cross-sectional view for the configuration of FIG. 14 with the latch mechanisms in an unengaged position.
Figure 16:
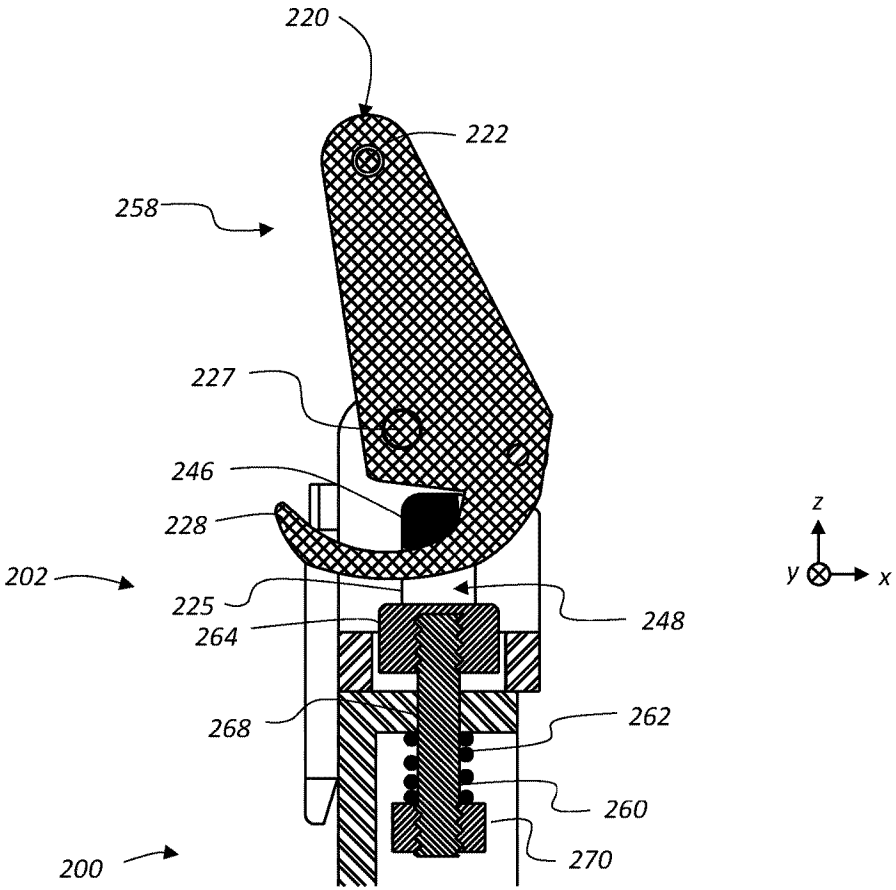
FIG. 16 shows a cross-sectional view for the configuration of FIG. 14 with the latch mechanisms in an engaged position.

FIGS. 14-16 illustrate another form of latch mechanism 220 in which a claw- or finger-like latch fastener 228 rotates into an the latch keeper 225. In this embodiment of a latch mechanism 220, the latch fastener 228 pivots around a pivot axis 227 that is parallel to the attachment face 230.

Another common form of latch mechanism 200 includes a bolt-like latch fastener 228 (not illustrated). In such latch fasteners 228, the latch bolt typically follows a straight path that is parallel to the attachment face 230 to engage and disengage the latch keeper 225. An example of a bolt-like latch fastener 228 would be a dead bolt lock.

Figure 12A:
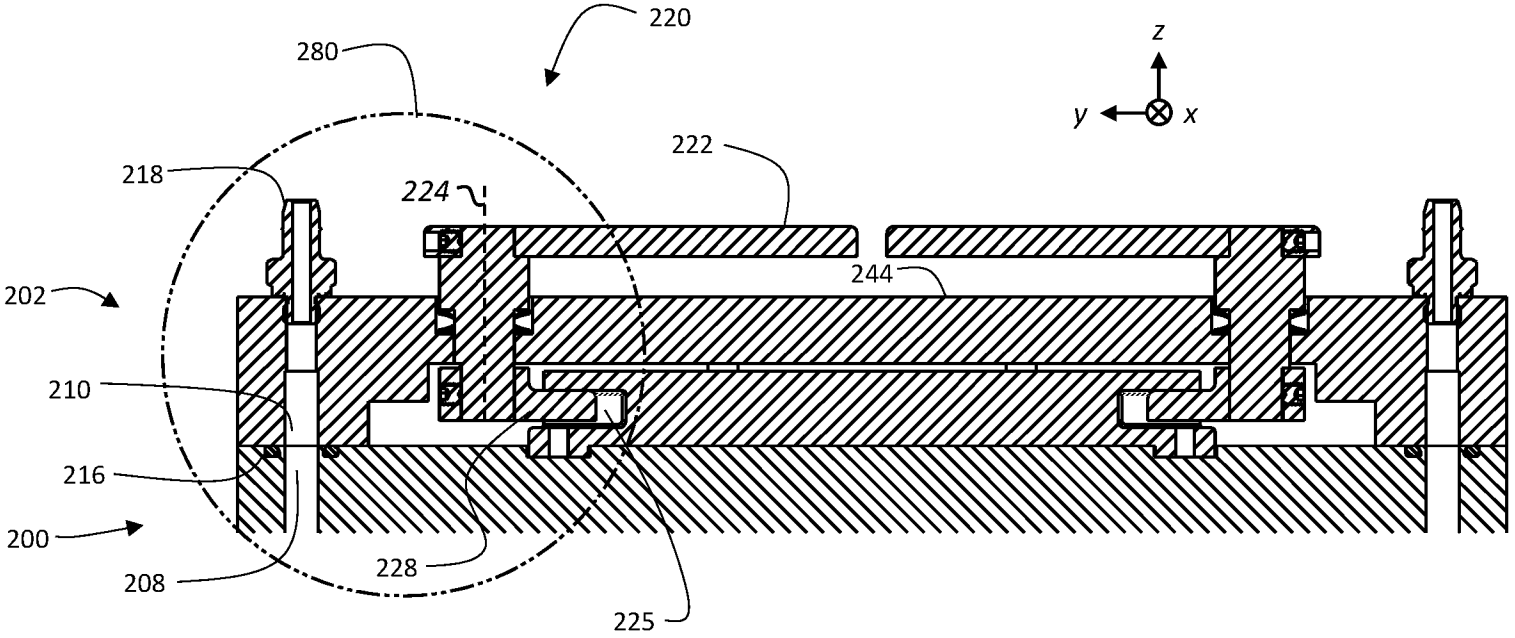
FIG. 12A-12B show a cross-sectional view through the configuration of FIG. 5 showing additional details of the latch fastener and latch keeper.
Figure 12B:
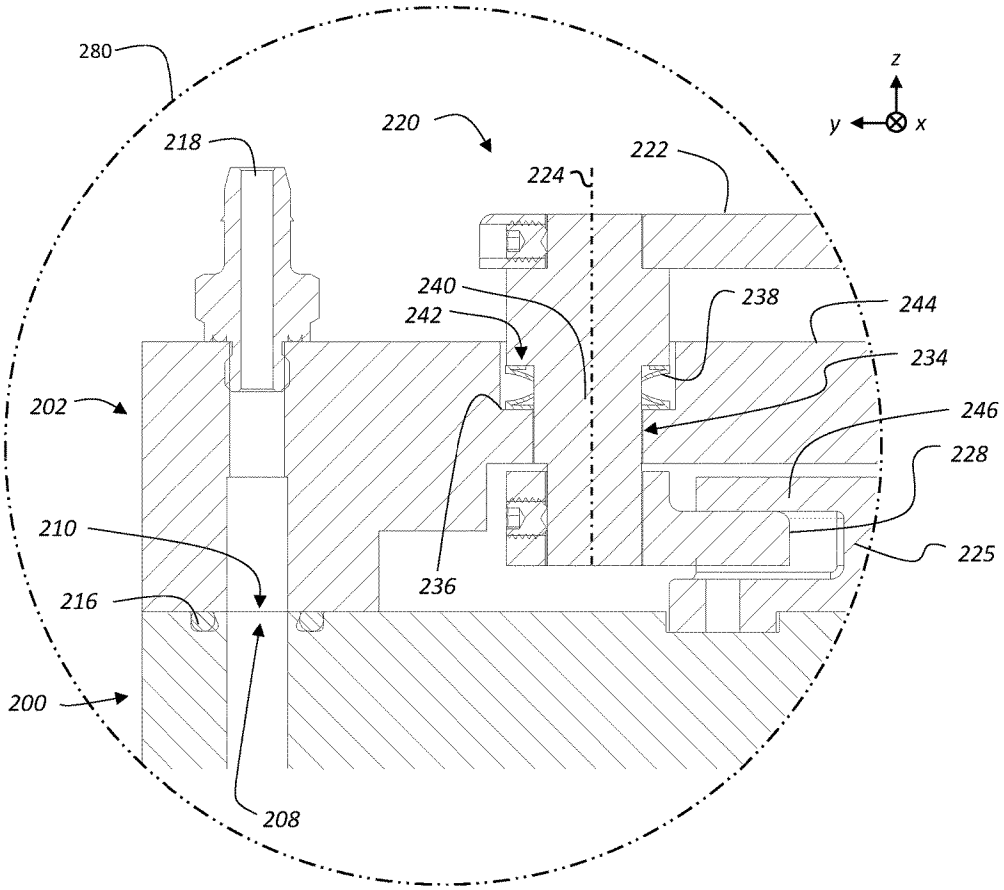

For the latch mechanism 220 to provide the desired compression force on the sealing element 216, the latch mechanism must provide a force holding the latch fastener in contact with the latch keeper. In preferred embodiments, the holding force is provided by one or more springs. In the embodiment of FIG. 5, more details of which are shown in the cross-section view of FIG. 12A and the corresponding enlarged region 280 shown in FIG. 12B, a spring 238 surrounds a shaft 240, which passes through a hole 234 in the body 244 of coupling assembly 202 and which links the latch handle 222 to the latch fastener 228. The hole 234 includes a counterbore 236, and the spring 238 is compressed and held captive between the bottom of the counterbore 236 and a shoulder 242 on the shaft 240. The spring 238 pushes the latch mechanism 220 upward relative to the body 244 of the fluid coupling assembly 202. When the fluid coupling assembly 202 is installed on the jetting module and the latch handles 220 are rotated to the second position, the spring 238 provides an upward force on the latch fastener 228 to hold it in contact with the catch 246 of the latch keeper 225. The spring 238 also provides a downward force on the body 244 of the fluid coupling assembly 202 to compress the sealing element 216 adjacent to the fluid ports 208, 210.

The latch keepers 225 can also take many different forms depending on the configuration of the latch mechanism 220. When cam-style latch fasteners 228 are used (as in FIGS. 5-7), the latch keeper 225 has a catch 246 that is approximately parallel to the attachment face 232 as shown in more detail in FIG. 13. A recess 250 behind the catch 246 for receiving the latch fastener 228 is typically open on two or three sides to allow the latch fastener 228 to rotate in behind the catch 246 of the latch keeper 225. The latch keepers 225 for claw-like latch fasteners 228, such as those illustrated in FIGS. 14-16, typically have an opening 248 behind the catch 246 through which the claw-like latch fastener 228 can pass. The latch keepers 225 for bolt-like latch fasteners 228 tend to have a blind hole behind the catch 246 for receiving the latch fastener 228 (not illustrated).

Figure 13:
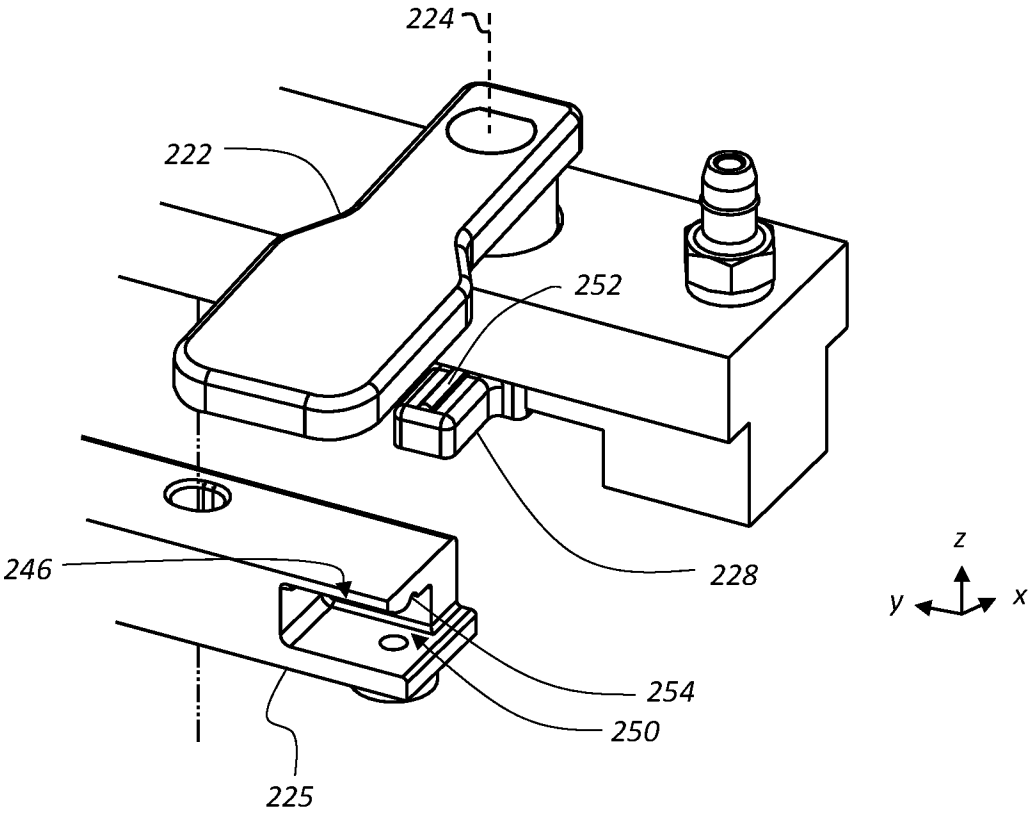
FIG. 13 shows additional details of the latch fastener and latch keeper in the configuration of FIG. 5.

In the illustrated exemplary configuration, the latch mechanism 220 includes a detent mechanism to provide a positive feel that the latch mechanism 220 is been moved into the latched position (i.e., the second position 258), and to prevent the latch mechanism 220 unintentionally shifting out of the latched position due to vibration or other causes. In the configuration of FIG. 13, the detent mechanism includes a detent 254 in the catch 246 of the latch keeper 225 for retaining a protrusion 252 on the latch fastener 228. In some configurations, the protrusion 252 can include a spring-biased ball or some other form of spring-biased protrusion. Alternatively, a spring 238 (see FIG. 12B) around the shaft 240 of the latch mechanism 220 can provide the spring action of the detent mechanism. In such an embodiment, once the protrusion 252 on the latch fastener 228 engages the detent 254 in the catch 246, the holding force provided by the spring 238 resists a shifting of the latch fastener 228 away from the latched position. Detent mechanisms are well known in the art, and they can be configured to engage the latch fastener (as in the FIG. 13), to engage the latch handle, to engage the shaft, or to engage some other mechanism linking the latch handle 222 to the latch fastener 228.

Returning to a discussion of FIG. 5, the repositionable latch handle 222 is a lever that is rigidly attached via the shaft 240 to the latch fastener 228. The latch handle 222 and the latch fastener 228 are rotated around a pivot axis 224 oriented normal to the attachment face 230 of the fluid coupling assembly 202 between a first position (see FIG. 6) and a second position (see FIG. 7). More generally, motion of the latch handle 222 between the first and the second positions can involve a rotation of the latch handle 222 around a pivot axis 224, 227 linear translations, or more complex motion paths. Similarly, the motion of the latch fastener 228 between the engaged and disengaged positions can involve a rotation of the latch fastener 228 around a pivot axis 224, 227, linear translations, or more complex motion paths. In the embodiment of FIG. 5, the two latch mechanisms 220 (including latch handles 222 and latch fasteners 228) and the corresponding latch keepers 225 have mirror symmetry about a line midway between them. Due to this mirror symmetry, moving one of the latch handles 222 to the first position constitutes a clockwise rotation of the latch handle, while moving the other latch handle 222 to the first position constitutes a counter clockwise rotation, but this is in no way limiting. In this embodiment, each latch mechanism 220 is operated by a corresponding repositionable latch handle 222. In other embodiments, such as the one shown in FIG. 14, more than one latch mechanism 220 can be operated with a single latch handle 222

Figure 8:
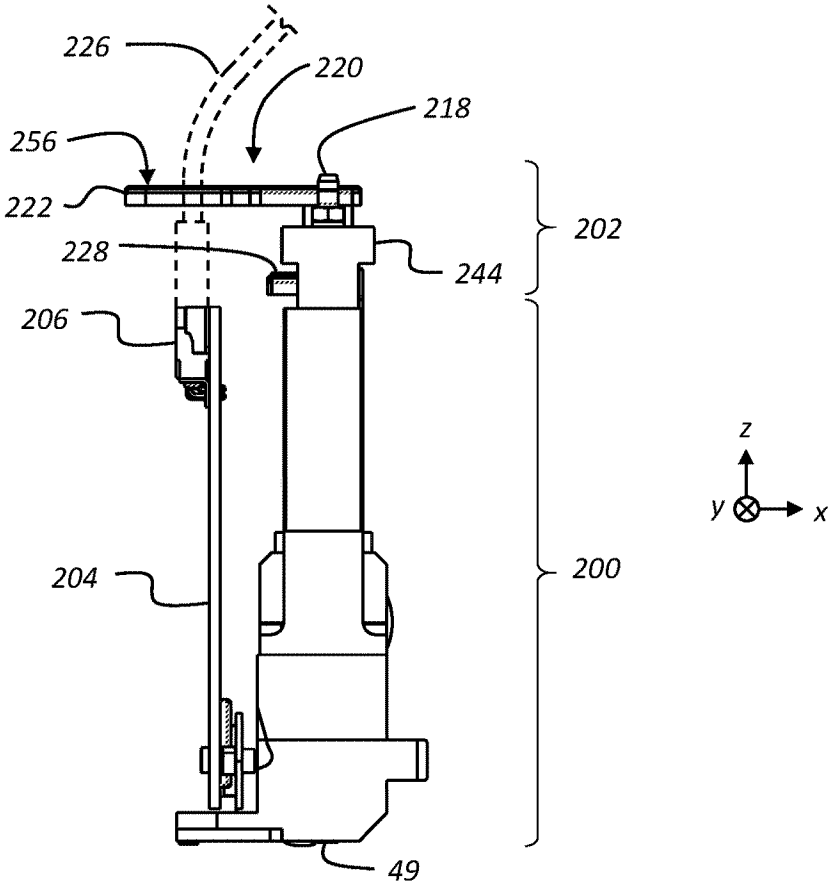
FIG. 8 shows a side view for the configuration of FIG. 6 with the latch mechanisms in an unengaged position.

As is shown more clearly in FIG. 8, when the latch handles 220 are in the first position 256 such that the latch fasteners 228 are in the disengaged position relative to the latch keepers 225, there is a geometric interference between the latch mechanism 220 and the connected position of the one or more electrical cables 226 such that the electrical cables 226 cannot be connected to the electrical connectors 206. The interference between the latch mechanism 220 and electrical cables 226 can involve an interference between the electrical cable 226 and one or more portions of the latch mechanism 220 such as with the latch handle 222, the latch fastener 228, or any other part of the latch mechanism 220 which is linked to the position of the latch handle 222. If the fluid coupling assembly 202 is installed on the jetting module 200 prior to connecting the electrical cable 226 and the latch handle 222 is oriented in the first position, then the interference between the electrical cable 226 and the latch handle 222 blocks access to the electrical connector 206 of the jetting module 200 so that the electrical cable 226 cannot be installed into the electrical connector 206.

In the context of this invention, an electrical cable 226 can include not only multi-conductor electrical cables in coaxial or side by side configurations but also flexible circuit connections, individual wires or optical fiber through which electrical signals, electrical power, or electrical ground levels can be supplied to the jetting module 200 through a corresponding electrical connector 206 of the jetting module 200. The electrical connector 206 of the jetting module 200 can comprise any type of connector through which any of these forms of electrical cable 226 can be coupled to the jetting module 200.

Figure 9:
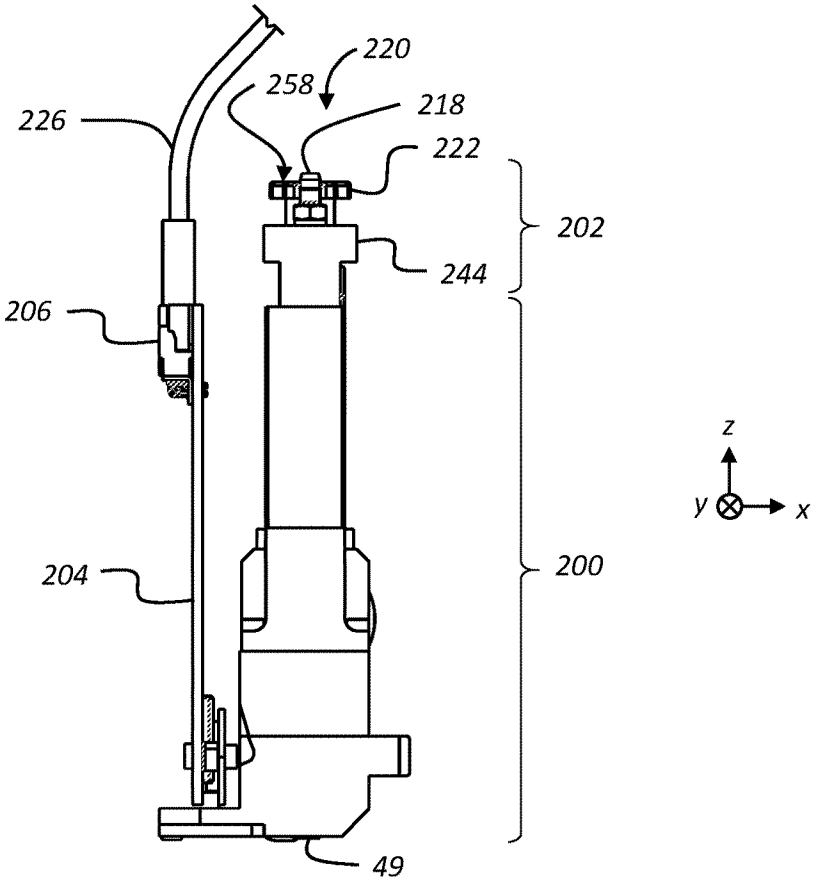
FIG. 9 shows a side view for the configuration of FIG. 7 with the latch mechanisms in an engaged position.

As shown in FIG. 9, when the latch handles 222 are oriented in the second position 258, in which the latch fasteners 228 engage with the latch keepers 225, then the latch handles 222 do not block access to the electrical connectors 206 allowing the electrical cables 226 to be connected to the electrical connectors 206.

The interference between the electrical cable 226 and the latch mechanism 220 while the latch handle 222 is in the first position 256, also prevents an operator from changing the positioning the latch handle 222 from the latched second position 258 to the unlatched first position 256 while the electrical cable 226 is installed in the electrical connector 206. The interference between the electrical cable 226 and the latch mechanism 220 while the latch handle 222 is in the first position 256 also prevents an operator from first installing the electrical cable 226 into the electrical connector 206 and then installing the fluid coupling assembly 202 onto the jetting module 200 as the interference prevents the fluid coupling assembly 202 from being seated onto the jetting module 200.

The interference between the electrical cable 226 and the latch mechanism 220 when the latch handle 222 is in the first position 256, therefore requires the operator to first install the fluid coupling assembly 202 and engage the latch mechanism 220 with the latch keeper 225 by orienting the latch handle 220 in the second position 258 prior to installing the electrical cable 226. It also requires the operator to disconnect the electrical cable 226 from the electrical connector 206 of the jetting module 200 prior to disengaging the latch mechanism 220 by reorienting the latch handles 222 to the first position 256.

In the context of this invention, the interference between the latch mechanism 220 and the electrical cable 206 can constitute a direct interference between some portion of the latch mechanism 220 and the electrical cable 226, or an indirect interference in which some portion of the latch mechanism 220 interferes with the connector at the end of the electrical cable 226, such that the direct or indirect interference prevents the connecting the electrical cable 226 to the electrical connector 206 of the jetting module 200.

To prevent leakage at the junction between the jetting module fluid ports 208 with the coupling assembly fluid ports 210, it is desirable to include a compressible sealing element 216 adjacent to each of the mating pair of fluid ports 208, 210 (see FIG. 5). Typically, the compressible sealing element 216 can be an elastomeric O-ring or a compressible gasket that surrounds the fluid ports 208, 210. Preferably one or both of the attachment faces 230, 232 include features, such as O-ring grooves, for locating and retaining the compressible sealing elements 216 adjacent to the fluid ports 208, 210. In alternate embodiments, at least a portion of one or both the jetting module attachment face 232 and the coupling assembly attachment face 230 are formed of a compliant material, such as a plastic material, that can be compressed to provide a leak proof seal when the fluid coupling assembly 202 is latched to the jetting module 200. When the latch handle 222 is in the second position 256 to latch the fluid coupling assembly 202 to the jetting module 200 in the embodiment of FIG. 5, the latch mechanism 220 provides a force on the fluid coupling assembly 202 that compresses the compressible sealing element 216 between the fluid coupling assembly 202 and the jetting module 200 to provide the leak-proof fluid connection between the jetting module fluid port 210 and the coupling assembly fluid port 208.

Figure 10:
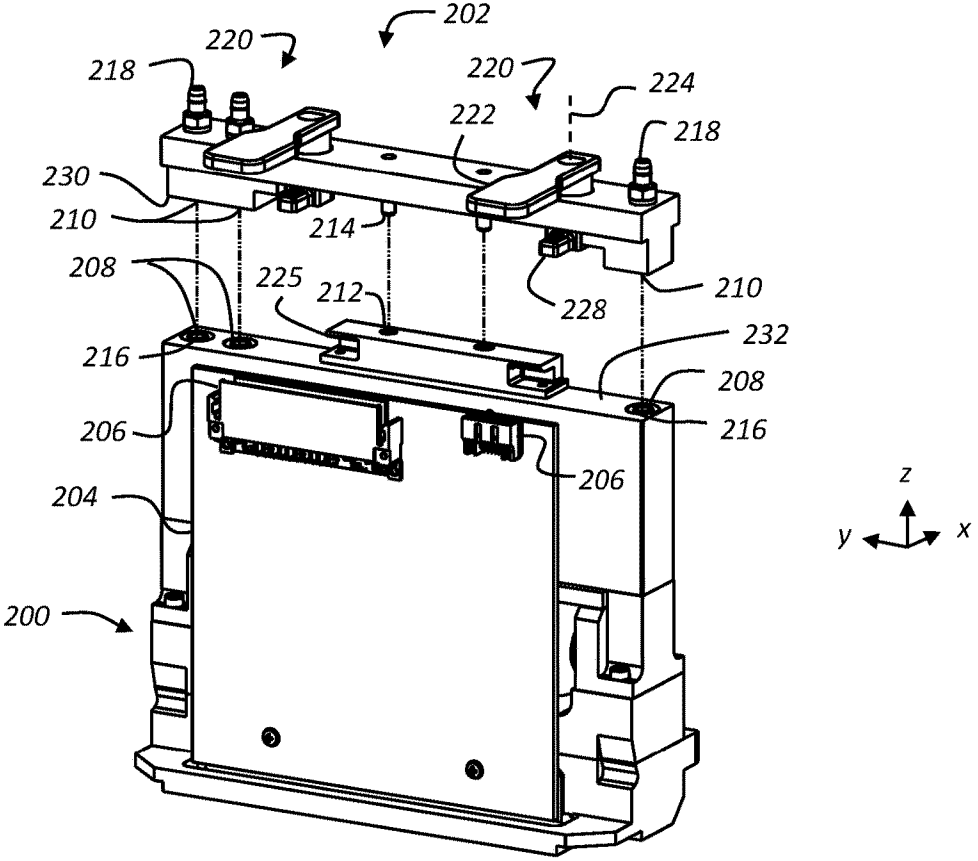
FIG. 10 shows an isometric view of a jetting module and a fluid coupling assembly which each include three fluid ports in accordance with an alternate embodiment.

In the embodiment of FIG. 5, the jetting module 200 has two jetting module fluid ports 208 and the fluid coupling assembly 202 has two coupling assembly fluid ports 210 in corresponding positions. The two fluid ports 208 correspond to an inlet fluid port for supplying liquid from the printing system ink reservoir 40 (FIG. 1) to the jetting module 200, and an outlet fluid port through which liquid can be returned from the jetting module 200 through ink recycling unit 44 to the fluid system 39 (FIG. 1). The invention is not limited to configurations using two fluid ports. FIG. 10 shows an alternate configuration where the jetting module 200 and the fluid coupling assembly 202 each have three fluid ports 208, 210. In this embodiment, the third fluid port 208 provides an air bleed outlet port for a filter (not shown) within the jetting module 200. Typically, this third fluid port 208 is in fluid communication with the ink reservoir from which any air bleed out from the filter can be vented to the atmosphere. In other embodiments, more commonly used for drop-on-demand jetting modules, the jetting module 200 and the fluid coupling assembly 202 may each have only one fluid port 208, 210.

Figure 11:
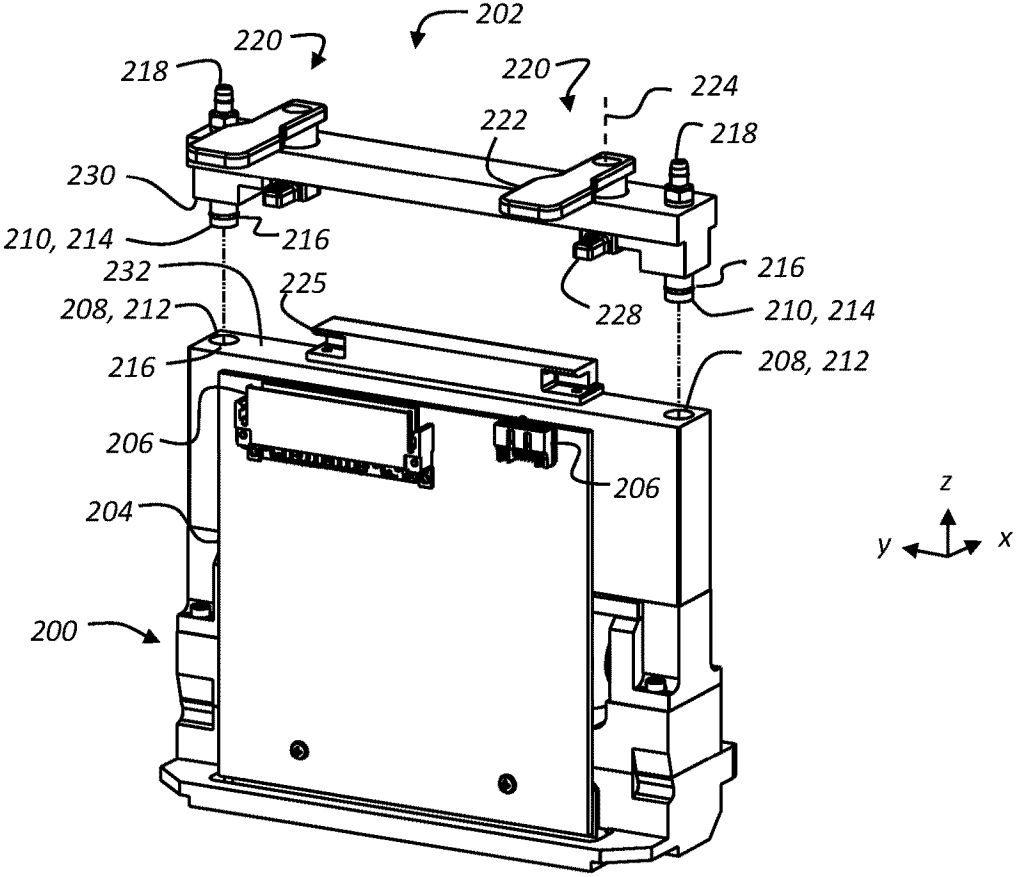
FIG. 11 shows an isometric view of a jetting module and a fluid coupling assembly which include male and female fluid ports in accordance with an alternate embodiment.

FIG. 11 illustrates an alternate configuration where the mating pair of fluid ports 208, 210 of the jetting module 200 and the fluid coupling assembly 202 are configured as a mating set of male and female fluid ports. In such embodiments, typically a gland seal is used, in which the compressible sealing element 216 is an O-ring located and retained by a groove around the male fluid port 210. The compression of such a sealing element 216 is controlled by the selected diameters of the male fluid port 210 and the female fluid port 208. In such embodiments, the engagement of the mating set or sets of fluid ports 208, 210 can serve as alignment features 214 so that separate alignment features may not be necessary.

FIGS. 14-18 illustrate another embodiment of a fluid coupling latching system. FIG. 14 shows an isometric view of a jetting module 200 with a fluid coupling assembly 202 positioned above the jetting module ready for installation on the jetting module 200. The attachment face 232 of the jetting module 200 includes two jetting module fluid ports 208. Positioned around the jetting module fluid ports 208 are sealing members 216. The attachment face 230 of the fluid coupling assembly 202 includes two coupling assembly fluid ports 210 at positions that correspond with the positions of the jetting module fluid ports 208. The attachment face 232 also includes two latch keepers 225. The fluid coupling assembly 202 includes latch mechanisms 220 for engaging the latch keepers 225. In this embodiment, a single latch handle 222 simultaneously operates both latch mechanisms 220.

FIGS. 15 and 16, which are cross-sectional views through the latch mechanism 220 and latch keeper 225, provide more detail on the latching system. The latch mechanism 220 includes a claw-like latch fastener 228. In FIG. 15, the latch handle 222 is in the first position 256 in which the latch mechanism 220 is disengaged from the latch keeper 225. In the first position 256, the latch fastener 228 is moved out of the way so that the fluid coupling assembly 202 can be installed on the jetting module 200. When the fluid coupling assembly 202 is set onto the jetting module, the latch keepers 225 on the jetting module 200 protrude through openings 266 in the fluid coupling assembly 202. The openings 266 in the fluid coupling 202, and the latch keepers 225 of the jetting module 200 can serve as alignment features to ensure that the fluid coupling assembly 202 is properly positioned relative to the jetting module 200. Additionally, a blade 272 (FIG. 15) that engages a receptacle (not shown) in the jetting module can serve as an additional alignment feature 214.

As the latch handle 222 is pivoted around the pivot axis 227 from the first position 256 (shown in FIG. 15) to the second position 258 (shown in FIG. 16), the latch fastener 228 passes through the opening 248 in the latch keeper 225 with a face of the latch fastener 228 contacting the catch 246 of the latch keeper 225. The distance from the pivot axis 227 to the point where the catch 246 contacts face of the latch fastener 228 decreases as the latch handle is moved from the first position 256 to the second position 258. Rotating the latch handle 222 from the first position 256 to the second position 258 therefore produces an upward pull on the latch keeper 225. In the illustrated embodiment, the latch keeper 225 is compliantly attached to the jetting module 200. A base 264 of the latch keeper 225 is attached to a shaft 260 that passes through an opening 268 in the attachment face 232 (FIG. 14) of the jetting module 200. A spring 262 is positioned around the shaft 260, and is captive between the body of the jetting module 200 and a nut 270 attached to the end of the shaft 260. The upward pull on the latch keeper 225 by the latch fastener 228 compresses the spring 262. When the latch handle 220 is in the second position 258, the compression of the spring 262 causes the spring 262 to provide a force holding the catch 246 of the latch keeper 225 in contact with the latch fastener 228, and to provide the compression force on the sealing elements 216 located around the fluid ports 208, 210. The compliance provided by the springs 262 gives the latch system latitude to be able to accommodate the stack of component tolerances, while still being able to ensure that the fluid coupling assembly 202 is appropriately latched to the jetting module 200.

Figure 17:
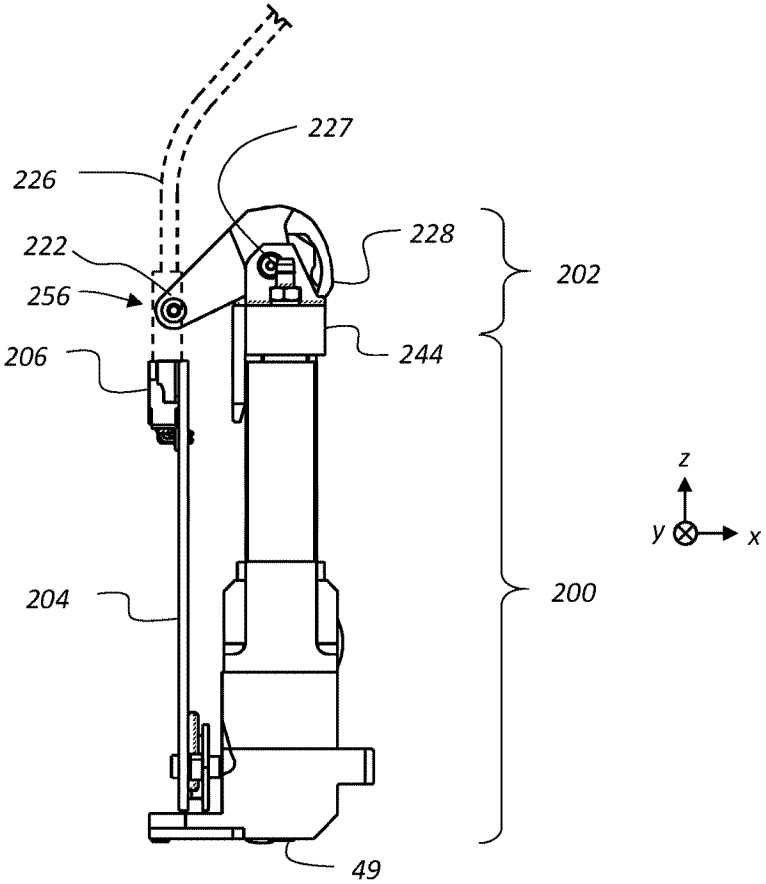
FIG. 17 shows a side view for the configuration of FIG. 14 with the latch mechanisms in an unengaged position.

As illustrated in FIG. 17, when the latch handle 222 is in the first position 256, there is an interference between the latch handle 222 and the connected position of the electrical cable 226. In this case the interference with the electrical cable 226 includes an interference with the connector attached to the electrical cable 226. This interference blocks access to the electrical connector 206 preventing an operator from attaching the electrical cable 226 to the electrical connector 206 on the electronics board 204 of the jetting module 200 while the latch handle 222 is in the first position 256. This same interference also precludes installing the fluid coupling assembly 202 on the jetting module 200 (which requires the latch handle to be in the first position 256) when the electrical cable 226 is already attached to the electrical connector 206.

Figure 18:
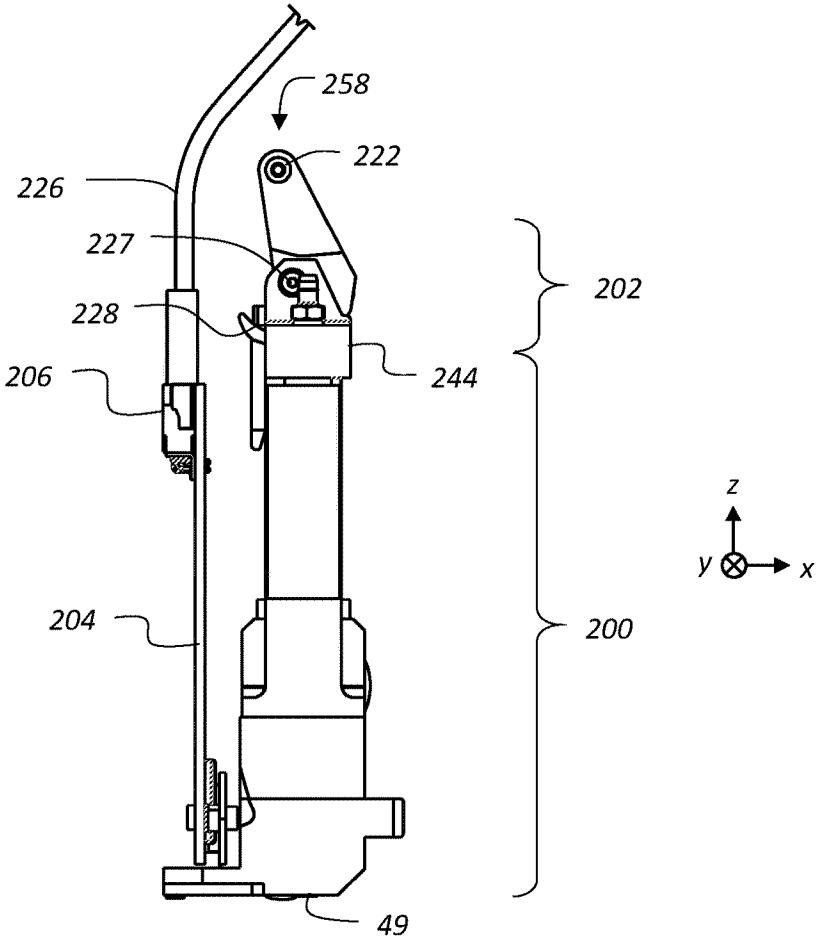
FIG. 18 shows a side view for the configuration of FIG. 14 with the latch mechanisms in an engaged position.

After the fluid coupling assembly 202 is latched in place on the jetting module 200 by moving the latch handle 222 to the second position 258 as shown in FIG. 18, then access is provided to the electrical connector 206 so that the electrical cable 226 can be attached to the electrical connector 206. This interference between the electrical connector 226 and the latch handle 222 when the latch handle is in the first position 256 forces the operator to first install the fluid coupling assembly 202 on the jetting module 200 and latch it in place by moving the latch handle 222 to the second position 258.

As with the previous embodiment, this latching system can also include a detent mechanism to provide a positive feel that the latch mechanism 220 is been moved into the latched position, and to prevent the latch mechanism unintentionally shifting out of the latched position due to vibration or other causes. Detent mechanisms are well known in the art, and they can be configured to engage the latch fastener 228, the latch handle 222, or other mechanisms linking the latch handle 222 to the latch fastener 228. In the illustrated configuration, the latching system includes a flexible rod 274 which extends between the two latch mechanisms 220. As the latch handle 222 is rotated into the second position 258, the rod 274 flexes slightly as it passes a bracket 279 mounted onto the fluid coupling assembly 202 until a sleeve 276 around the flexible rod 274 snaps into a detent 278 formed in the bracket 279.

In both of the embodiments described above, the jetting module 200 includes two latch keepers 225 and the fluid coupling assembly 202 includes two corresponding latch mechanisms 220. More generally, the jetting module 200 can include any number of latch keepers 225 with the fluid coupling assembly 202 including a corresponding number of latch mechanisms 220. For example, in other embodiments, the jetting module 200 can include a single latch keeper 225 and the fluid coupling assembly 202 can include a corresponding single latch mechanism 220. In another example, the jetting module 200 can include three latch keepers 225 and the fluid coupling assembly 202 can include three corresponding latch mechanisms 220.

In a preferred embodiment of the inkjet printing system 20, the system micro-controller 38 (FIG. 1) can determine whether the electrical cable 226 is connected to the electrical connector 206 of the jetting module electronics board 204. One method for making this determination involves the micro-controller 38 sending a particular electrical signal through the electrical cable 226 to the jetting module electronics board 204. If the electronics cable 226 is connected to the electrical connector 206, the electronics board 204 will, upon detecting the particular electrical signal, send an appropriate response signal back to the micro-controller 38. Upon detecting the appropriate response signal, the micro-controller 38 has confirmation that the electrical cable 226 is installed in the electrical connector 206 on the jetting module 200. As the electrical cable 226 must be connected to the jetting module 200 after the fluid coupling assembly 202 is latched to the jetting module with the latch handle in the second position 258, the controller 38 can then safely control the fluid system 39 to supply fluids to the jetting module 200.

The fluid coupling latching system of the present invention has been described for use in a continuous inkjet printing system 20, but the invention is applicable to other types of inkjet printing systems such as drop-on-demand printing systems in which fluid and electrical connections must be made to a jetting module 200. More generally, the fluid coupling latching system of the invention can be used to latch a fluid coupling assembly 202 with any fluid processing module for which both fluid and electrical connections must be made. In such systems, the fluid coupling latching system having a latch handle 222 with a first position 256 in which the latch fastener 228 is disengaged from a latch keeper 225 on the fluid processing module, and a second position 258 in which the latch fastener 228 is engaged with the latch keeper 225 of the fluid processing module latch. Wherein when the latch handle 222 is in the first position 256 a portion of the latch mechanism 220 blocks an electrical connector 206 of the fluid processing module such that an electrical cable 226 is prevented from being connecting with the electrical connector 206, and when the latch handle 222 is in the second position 258 the electrical connector 206 is not blocked such that the electrical cable 226 can be connected with the electrical connector 206.

Examples of fluid processing modules for which the fluid coupling latching system of the present invention would be useful would include spray heads for electrostatic painting systems or powder coater systems. In electrostatic painting systems, some form of a liquid paint is sprayed from the spray head and the drops of paint are electrostatically charged. The charged drops are then attracted to the grounded conductive object to be painted. In powder coating systems, dry particles of the coating material are carried by a flow of air or other gas out of the spray head. An electrostatic charge is applied to the dry particles so that they are attracted to and adhere to the grounded conductive object to be coated. In both types of systems one or more fluid lines are connected to the spray head for supplying a fluid to be ejected from the spray head. Electrical connections must also be made to the spray heads for applying an electrostatic charge to the material ejected from the spray heads. In both applications, it is important that the fluid couplings be securely latched in place to the spray head before activating a pump for delivering material to the spray head. The invention is also applicable to various forms of microfluidic devices, such as "lab on a chip" or "micro total analysis systems," in which both fluid and electrical connections must be made to the microfluid devices.

The invention has been described in detail with particular reference to certain preferred embodiments thereof, but it will be understood that variations and modifications can be effected within the spirit and scope of the invention.

PARTS LIST

20 printing system
22 image source
24 image processing unit
26 control circuits
27 synchronization device
28 drop forming transducer
30 printhead
32 print medium
34 print medium transport system
35 speed measurement device
36 media transport controller
38 micro-controller
39 fluid system
40 ink reservoir
44 ink recycling unit
46 ink pressure regulator
47 ink channel
48 jetting module
49 nozzle plate
50 nozzle
51 heater
52 liquid stream
54 drop
55 drop formation waveform source
57 trajectory
59 break off location
60 drop formation waveform
61 charging device
62 charging electrode
62' charging electrode
63 charging electrode waveform source
64 charging electrode waveform
66 printing drop
68 non-printing drop
69 drop selection system
70 deflection mechanism
71 deflection electrode
72 ink catcher
74 catcher face
76 ink film
78 liquid channel
79 lower plate
80 charging electrode waveform period
82 first voltage state
84 second voltage state
86 non-print trajectory
88 print dot
92-1 drop formation waveform
92-2 drop formation waveform
92-3 drop formation waveform
94-1 drop formation waveform
94-2 drop formation waveform
94-3 drop formation waveform
94-4 drop formation waveform
96 period
98 pulse
100 period
102 pulse
104-1 large drop
104-2 large drop
104-3 large drop
106-1 small drop
106-2 small drop
106-3 small drop
106-4 small drop
108 phase shift
200 jetting module
202 fluid coupling assembly
204 electronics board
206 electrical connector
208 fluid port
210 fluid port
212 alignment feature
214 alignment feature
216 sealing element
218 fittings
220 latch mechanism
222 latch handle
224 pivot axis
225 latch keeper
226 electrical cable
227 pivot axis
228 latch fastener
230 attachment face
232 attachment face
234 hole
236 counterbore
238 spring
240 shaft
242 shoulder
244 body
246 catch

248 opening
250 recess
252 protrusion
254 detent
256 first position
258 second position
260 shaft
262 spring
264 base
266 opening
268 opening
270 nut
272 blade
274 rod
276 sleeve
278 detent
279 bracket
280 region

The invention claimed is:

1. An inkjet printing system, comprising:

a jetting module including:

an electrical connector adapted to connect with a corresponding electrical cable;

a jetting module attachment face including a jetting module fluid port; and a latch keeper; and a fluid coupling assembly that provides a fluid coupling to the jetting module including:

a coupling assembly attachment face including a coupling assembly fluid port in a position corresponding to the jetting module fluid port; and a latch mechanism including:

a latch fastener adapted to engage with the latch keeper; and a repositionable latch handle for operating the latch mechanism;

wherein when the latch handle is in a first position the latch fastener is disengaged from the latch keeper, and when the latch handle is in a second position the latch fastener engages the latch keeper to secure the attachment face of the fluid coupling assembly to the attachment face of the jetting module such that there is a leak-proof fluid connection between the jetting module fluid port and the coupling assembly fluid port; and wherein when the latch handle is in the first position a portion of the latch mechanism blocks the electrical connector such that the electrical cable is prevented from connecting with the electrical connector, and when the latch handle is in the second position the electrical connection is not blocked such that the electrical cable can be connected with the electrical connector.

2. The inkjet printing system of claim 1, further including a spring which provides a holding force between the latch mechanism and the latch keeper when the fluid coupling assembly is secured to the jetting module.

3. The inkjet printing system of claim 1, further including a compressible sealing element surrounding the jetting module fluid port and the coupling assembly fluid port, wherein the compressible sealing element is compressed when the latch handle is in the second position to provide the leak-proof fluid connection between the jetting module fluid port and the coupling assembly fluid port.

4. The inkjet printing system of claim 3, wherein the compressible sealing element is an O-ring or a gasket positioned between the fluid coupling assembly and the jetting module.

5. The inkjet printing system of claim 3, wherein at least a portion of the coupling assembly attachment face or the jetting module attachment face is formed of a compliant material which compresses when the latch handle is in the second position such that it serves as the compressible sealing element.

6. The inkjet printing system of claim 1, further including a fluid supply system to supply fluid to the coupling assembly fluid port.

7. The inkjet printing system of claim 6, further including a controller which receives electrical signals from the electrical cable to confirm that the electoral cable has been connected to the electrical connector before controlling the fluid supply system to supply fluid to the coupling assembly fluid port.

8. The inkjet printing system of claim 1, wherein the fluid coupling assembly and the jetting module include corresponding alignment features for aligning the fluid coupling assembly and the jetting module.

9. The inkjet printing system of claim 8, wherein the jetting module fluid port is a male fluid port which protrudes from the jetting module attachment face and the coupling assembly fluid port is a female fluid port which is recessed into the coupling assembly attachment face, wherein the male fluid port fits within the female fluid port to provide the corresponding alignment features.

10. The inkjet printing system of claim 1, wherein the jetting module includes a plurality of latch keepers and the fluid coupling assembly includes a corresponding plurality of latch fasteners.

11. The inkjet printing system of claim 10, wherein a single repositionable latch handle simultaneously operates the plurality of latch fasteners.

12. The inkjet printing system of claim 10, wherein each latch fasteners is operated by a corresponding repositionable latch handle.

13. The inkjet printing system of claim 1, wherein the jetting module includes a plurality of jetting module fluid ports and the fluid coupling assembly includes a corresponding plurality of coupling assembly fluid ports.

14. The inkjet printing system of claim 1, wherein the repositionable latch handle is a lever which is rigidly attached to the latch fastener, the lever and the latch fastener being adapted to pivot together around a pivot axis normal to the attachment face of the fluid coupling assembly, and wherein pivoting the latch handle into the first position causes the lever to block the electrical connector and pivoting the latch handle into the second position causes the latch mechanism to pivot around the pivot axis to engage with the latch keeper.

15. The inkjet printing system of claim 14, wherein pivoting the latch handle into the second position causes the latch mechanism to move under a catch on the latch keeper.

16. The inkjet printing system of claim 14, wherein the latch fastener includes a protrusion, and wherein engaging the latch fastener with the latch keeper causes the protrusion to engage with a detent on the latch keeper.

17. The inkjet printing system of claim 1, wherein the repositionable latch handle is rigidly attached to the latch fastener, the lever and the latch fastener being adapted to pivot together around a pivot axis parallel to the attachment face of the fluid coupling assembly, and wherein pivoting the latch handle into the first position causes the latch handle to block the electrical connector and pivoting the latch handle into the second position causes the latch fastener to pivot around the pivot axis to engage with the latch keeper.

18. The inkjet printing system of claim 17, wherein the latch fastener includes a claw, and wherein pivoting the latch fastener around the pivot axis to engage with the latch keeper causes the claw to be inserted into an opening in the latch keeper.

19. The inkjet printing system of claim 1, further including a detent mechanism which prevents the latch mechanism from unintentionally disengaging from the latch keeper.

20. A fluid coupling system, comprising:

a fluid processing module including:

an electrical connector adapted to connect with a corresponding electrical cable;

a processing module attachment face including a processing module fluid port; and a latch keeper; and a fluid coupling assembly that provides a fluid coupling to the fluid processing module including:

a coupling assembly attachment face including a coupling assembly fluid port in a position corresponding to the processing module fluid port; and a latch mechanism including:

a latch fastener adapted to engage with the latch keeper; and a repositionable latch handle for operating the latch mechanism;

wherein when the latch handle is in a first position the latch fastener is disengaged from the latch keeper, and when the latch handle is in a second position the latch fastener engages the latch keeper to secure the attachment face of the fluid coupling assembly to the attachment face of the fluid processing module such that there is a leak-proof fluid connection between the processing module fluid port and the coupling assembly fluid port; and wherein when the latch handle is in the first position a portion of the latch mechanism blocks the electrical connector such that the electrical cable is prevented from connecting with the electrical connector, and when the latch handle is in the second position the electrical connection is not blocked such that the electrical cable can be connected with the electrical connector.

* * * * *